US007542378B2

(12) United States Patent
Busch

(10) Patent No.: US 7,542,378 B2
(45) Date of Patent: Jun. 2, 2009

(54) ELECTROACOUSTIC TRANSDUCER ARRANGEMENT FOR UNDERWATER ANTENNAS

(75) Inventor: Rainer Busch, Oldenburg (DE)

(73) Assignee: Atlas Elektronik GmbH, Bremen (DE)

( * ) Notice: Subject to any disclaimer, the term of this patent is extended or adjusted under 35 U.S.C. 154(b) by 0 days.

(21) Appl. No.: 11/658,862

(22) PCT Filed: Jun. 15, 2005

(86) PCT No.: PCT/EP2005/006383

§ 371 (c)(1),
(2), (4) Date: Jan. 30, 2007

(87) PCT Pub. No.: WO2006/015646

PCT Pub. Date: Feb. 16, 2006

(65) Prior Publication Data

US 2008/0008046 A1 Jan. 10, 2008

(30) Foreign Application Priority Data

Aug. 5, 2004 (DE) ..... 10 2004 038 032

(51) Int. Cl.
*B06B 1/06* (2006.01)

(52) U.S. Cl. ..... 367/151

(58) Field of Classification Search ..... 367/140, 367/141, 151, 153, 154, 173; 310/322, 325, 310/327, 334, 345, 348, 800
See application file for complete search history.

(56) References Cited

U.S. PATENT DOCUMENTS 4,669,573 A 6/1987 Goodman
4,964,091 A * 10/1990 Cook ..... 367/165
5,499,219 A 3/1996 Brenner et al.
2006/0192465 A1* 8/2006 Kornbluh et al. ..... 310/800
2008/0008046 A1* 1/2008 Busch ..... 367/151

FOREIGN PATENT DOCUMENTS

DE 68 12 194 U1 12/1970
DE 27 08 396 C2 9/1977
DE 36 35 364 A1 4/1988
DE 10323493 B3 * 7/2004
EP 0 654 953 A1 5/1995

(Continued)

*Primary Examiner*—Dan Pihulic
(74) *Attorney, Agent, or Firm*—Fitch, Even, Tabin & Flannery

(57) ABSTRACT

The invention relates to an electroacoustic transducer arrangement for underwater antennas comprising: interspaced transducer elements (11); a reflector (12) that, in a sound incidence direction, is situated behind the transducer elements (11), with the reflector being comprised of a metal plate (13) facing the transducer elements (11) and of a foam material plate (14) located on the side of the metal plate (13) facing away from the transducer elements (11), and; an elastomer hard enclosing cast that encloses the transducer elements (11) and the reflector (12). The aim of the invention is to obtain a lightweight transducer arrangement with unchanged favorable performance data whereby having a broadened field of application. To this end, the metal plate (13) has a honeycomb structure, and a double layer (15) consisting of a foam material layer (16) adjacent to the metal plate (13) and of a cork layer (17) adjacent to the foam material plate (14) are arranged between the metal plate (13) and the foam material plate (14).

20 Claims, 1 Drawing Sheet

FOREIGN PATENT DOCUMENTS

| | | | | |
|---|---|---|---|---|
| EP | 1 249 827 | A1 | | 10/2002 |
| EP | 1253666 | A2 | * | 10/2002 |
| GB | 1 537 948 | | | 1/1979 |
| WO | WO 2004105176 | A2 | * | 12/2004 |
| WO | WO 2006015645 | A1 | * | 2/2006 |
| WO | WO 2006015646 | A1 | * | 2/2006 |

* cited by examiner

ELECTROACOUSTIC TRANSDUCER ARRANGEMENT FOR UNDERWATER ANTENNAS

CROSS REFERENCE TO RELATED APPLICATION

This Application is a U.S. Utility Patent Application filing under section 371 of International Patent Application PCT/EP2005/006383, filed Jun. 15, 2005, and claims priority from German Application No. 10 2004 038 032.5, filed Aug. 5, 2004, the complete disclosures of which are incorporated herein by reference.

BACKGROUND OF THE INVENTION

The invention relates to an electroacoustic transducer arrangement for underwater antennas of the generic type defined in the precharacterizing clause of claim 1.

In one known electroacoustic transducer arrangement (EP 0 654 953 B1), the reflector is a spring mass system comprising a mass, which is formed by the metal plate, and a spring, which is formed by the foam panel and carries sound poorly. The foam panel is in the form of an elastic soft-material panel composed of polyurethane foam. The metal plate is designed to suppress natural disturbance resonances by means of a sandwich structure with a film which is inserted between two metal sheets and damps bending waves. The individual transducer elements in the transducer arrangement are in the form of hydrophones. In order to produce the transducer arrangement, the reflector and a plug for connection of the hydrophones are inserted in a casting mold. The hydrophones are adhesively bonded to spacers in order to maintain an accurately toleranced distance from the reflector. The spacers are fixed accurately in position on the reflector, to be precise on its metal plate, for example by means of small indentations in the metal plate, or else by adhesive bonding. The spacers are produced from the same material as the hard encapsulation, which is preferably composed of polyurethane. Once the polyurethane has been injected into the casting mold and it is cured, the complete transducer arrangement is removed from the casting mold.

The invention is based on the object of providing a transducer arrangement of the type mentioned initially which has low weight with good performance data that is not changed, in order to increase the options and fields for its use.

SUMMARY OF THE INVENTION

According to the invention, the object is achieved by the features in claim 1.

The transducer arrangement according to the invention has the advantage that the honeycomb structure of the metal plate, in particular aluminum plate, achieves an enormous weight saving with the transducer arrangement having the same bending stiffness as that which is ensured by a solid plate. The arrangement of the thin double layer composed of a foam layer on the one hand and a material layer with a low acoustic impedance and low density, preferably a cork layer, on the other hand results in a reflector which is a good approximation to an ideal reflector and has a very good back-to-front ratio, despite the honeycomb structure of the metal plate. In comparison to an embodiment without any double layer between the honeycomb structure and the foam panel, the back-to-front ratio is increased by more than 25 dB for a transducer arrangement frequency range from 10 to 30 kHz.

Owing to its light weight, the transducer arrangement is most suitable for fitting to autonomous or remotely controlled underwater vehicles, for example as a receiving and/or transmitting antenna for a mine sonar for detection of mines around which sediment flows.

Expedient embodiments of the transducer arrangement according to the invention, together with advantageous developments and refinements of the invention, are specified in the further claims.

According to one advantageous embodiment of the invention, the foam panel is replaced by an air-filled cavity. In this case, the increase in the back-to-front ratio resulting from the double layer is even more than 45 dB, with respect to the same transducer arrangement frequency range of 10 to 30 kHz.

According to one advantageous embodiment of the invention, the transducer elements are attached to the metal plate by means of spacers composed of plastic. The height of the spacers is designed such that the distance between the acoustic center of the transducer elements and the reflector is small in comparison to the mean wavelength $\lambda$ of a broadband transducer arrangement, and is less than one quarter of the wavelength $\lambda$ of a narrowband transducer arrangement. This ensures that the sound which is reflected on the reflector is constructively superimposed on the sound which is directly received or transmitted by the transducer elements.

According to one preferred embodiment of the invention, that surface of the metal plate which points toward the transducer elements is coated with a thin layer composed of a material whose acoustic impedance is very much less than that of water, and is as close as possible to 1 $kg/m^2s$. This material layer, which has quite a low density and is preferably in the form of a cork layer, acts like an ideal reflector on the transducer elements, thus increasing the reception sensitivity of the transducer arrangement, being operated as a receiver, by up to 6 dB in comparison to the transducer elements in a free field. This also applies to the transmission level and the efficiency of the transducer arrangement when this is operated as an acoustic transmitter.

The invention will be described in more detail in the following text with reference to exemplary embodiments which are illustrated in the drawing, in which, illustrated schematically:

DETAILED DESCRIPTION OF THE INVENTION

Figure 1:
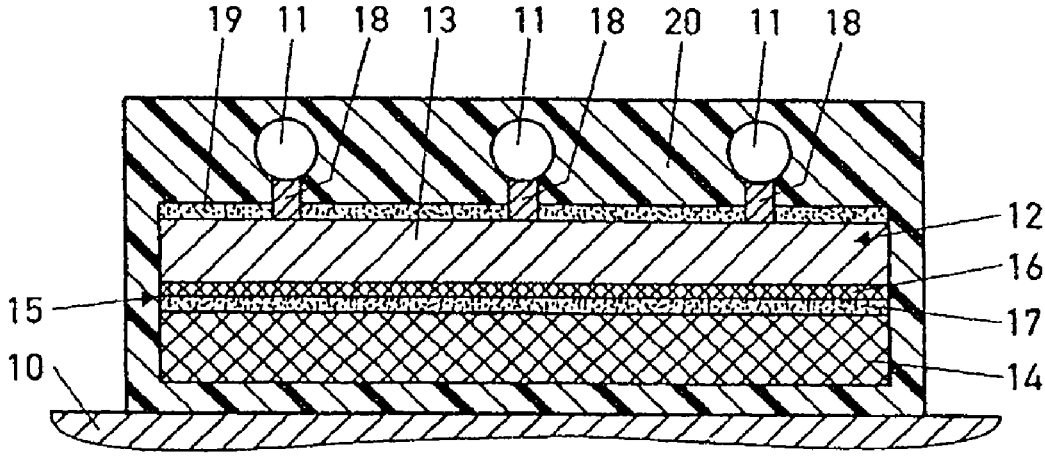
FIG. 1 shows a longitudinal section through an electroacoustic transducer arrangement having three transducer elements at a distance from one another.

The electroacoustic transducer arrangement which is sketched schematically in the form of a longitudinal section in FIG. 1 and is intended for an underwater antenna has, by way of example, three transducer elements 11 and a reflector 12 which is arranged behind the transducer elements 11 in the sound incidence direction. The transducer elements 11 may be not only transmitting transducers but also receiving transducers or hydrophones. In the latter case, the hydrophones are in the form of spherical ceramics, preferably ceramic hollow spheres, such as those described in U.S. Pat. No. 6,029,113 A. The transducer elements 11 and the reflector 12 are embedded in acoustically transparent hard encapsulation 13 composed of essentially viscous elastomer which can be processed using a casting method. By way of example, polyurethane (PUR) is used as the elastomer. The electrical connections which necessarily lead to the transducer elements 11 are not shown in the illustrations, for the sake of clarity.

Figure 2:
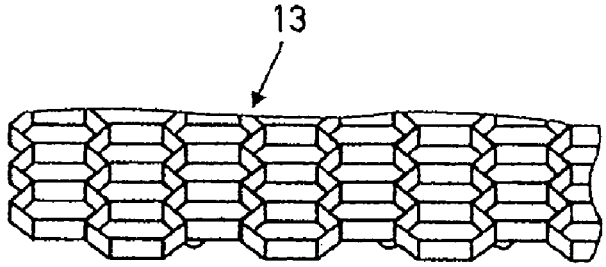
FIG. 2 shows a perspective illustration of a metal plate, in the form of a honeycomb structure, in the transducer arrangement shown in FIG. 1.

The reflector 12 comprises a metal plate 13 which faces the transducer elements 11 and has a honeycomb structure, and a foam panel 14 which faces away from the transducer elements 11 and is composed of pressure-resistant foam. The metal plate 13 together with the honeycomb structure, a plan view of which can be seen in the form of a detail, by way of example, in FIG. 2, is preferably manufactured from light metal, such as aluminum. A thin double layer 15 is arranged between the metal plate 13 and the foam panel 14 and comprises a foam layer 16 (which rests on the metal plate 13 and is composed of pressure-resistant foam) and a material layer 17, which rests on the foam panel 14 and is composed of a material whose acoustic impedance is very much lower than that of water, that is to say it has a very low density. Cork is preferably used as the material for the material layer 17, so that the following text refers only to a cork layer 17. The double layer 15 is relatively thin in comparison to the foam panel 14. By way of example, the layer thickness of the foam layer 16 is 4 mm, and the layer thickness of the cork layer 17 is 2 mm. In contrast, the layer thickness of the foam panel 14 composed of pressure-resistant foam is chosen to be 15-20 mm.

In order to maintain an accurately toleranced distance from the reflector 12, each of the transducer elements 11 is adhesively bonded to a spacer 18. The spacers 18 are fixed accurately in position to the metal plate 13 with a honeycomb structure, for example by means of small indentations in the metal plate 13, or else by adhesive bonding. The spacers 18 are preferably produced from the same material as the hard encapsulation 20. That surface of the metal plate 13 which points toward the transducer elements 11 is covered with a thin material layer 19 composed of a material whose acoustic impedance is very much lower than that of water. Cork is also used in the same way as in the case of the material layer 17 as a layer material with a low density for the material layer 19. The layer thickness of the cork layer 19 is, for example, approximately 2 mm. The cork layer 19 is cut out in the area of the spacers 18.

The height of the spacers 18 is chosen such that the distance between the acoustic center of the hydrophones and the metal plate 13 is small in comparison to the mean wavelength $\lambda$ for a transducer arrangement which transmits or receives with a broad bandwidth. For a transducer arrangement which transmits or receives with a narrow bandwidth, the height of the spacers 18 is chosen to be less than one quarter of the wavelength $\lambda$, that is to say less than $\lambda/4$.

Figure 3:
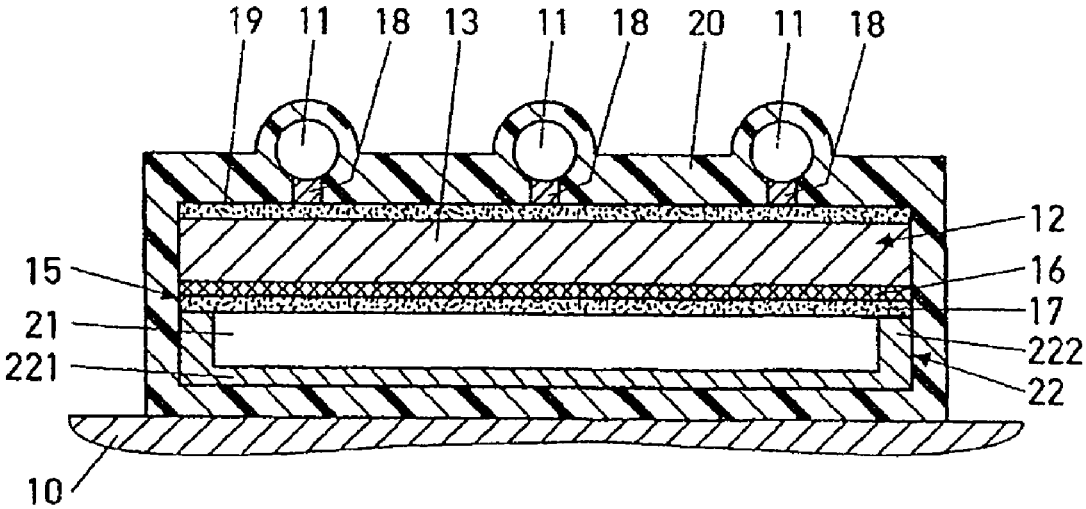
FIG. 3 shows the same illustration as in FIG. 1 of a modified transducer arrangement.

The transducer arrangement according to a further exemplary embodiment, which is illustrated in the form of a longitudinal section in FIG. 3, has been modified in comparison to the transducer arrangement described above by replacing the foam panel composed of pressure-resistant material by a closed cavity 21. A frame 22 with a U-shaped cross section and with a base plate 221 and a circumferential frame limb 222 is provided in order to create the cavity 21. On the side opposite the base plate 221, the frame 22 is covered by the cork layer 17 of the double layer 15, which rests on the free end of the frame limb 221 and thus encloses the cavity 21 together with the frame 22. The frame 22 is composed of a stiff material, for example of a light metal, in particular aluminum, or a pressure-resistant plastic or foam. The cavity 21 is preferably filled with air and, in addition to increasing the back-to-front ratio, is also used to accommodate electronic and electrical components for connection to the transducer elements 11.

The hard encapsulation 20 which encloses the transducer elements 11 and the reflector 12 is not in the form of a cuboid body as in FIG. 1, but is readjusted in the area of the sound incidence direction of the surface contour of the spherical transducer elements 11 by hemispherical bulges there covering a hemispherical part of the transducers with an approximately constant material thickness. This matching of the hard encapsulation 20 to the transducer contour results in the antenna arrangement having a wider beam angle.

The invention claimed is:

1. An electroacoustic transducer arrangement for underwater antennas, having transducer elements which are at a distance from one another, having a reflector which is arranged behind the transducer elements in the sound incidence direction and has a metal plate which faces the transducer elements, in particular an aluminum plate, and a foam panel which is located on the side of the metal plate facing away from the transducer elements, and having hard encapsulation composed of an elastomer which surrounds the transducer elements and the reflector, wherein the metal plate has a honeycomb structure, and a double layer, which is composed of a foam layer which rests on the metal plate and of a material layer which rests on the foam panel and is composed of a material whose acoustic impedance is very much less than that of water, is arranged between the metal plate and the foam panel.

2. The transducer arrangement as claimed in claim 1, wherein the double layer has a layer thickness which is small in comparison to the thickness of the foam panel and is preferably approximately 6 mm.

3. The transducer arrangement as claimed in claim 1, wherein the transducer elements are fixed to spacers, which are attached to the metal plate and are composed of plastic, and the height of the spacers is chosen such that the distance between the acoustic center of the transducer elements and the reflector for a broadband transducer arrangement is small in comparison to the mean wavelength $\lambda$, and for a narrowband transducer arrangement is less than one quarter of the wavelength $\lambda$.

4. The transducer arrangement as claimed in claim 1, wherein a surface of the metal plate which points toward the transducer elements is coated with a thin material layer composed of a material whose acoustic impedance is very much less than that of water.

5. The transducer arrangement as claimed in claim 1, wherein the material layer composed of the material with a low acoustic impedance is a cork layer.

6. The transducer arrangement as claimed in claim 5, wherein the layer thickness of the cork layer is approximately 2 mm.

7. The transducer arrangement as claimed in claim 1, wherein the foam panel is composed of pressure-resistant foam.

8. The transducer arrangement as claimed in claim 1, wherein the foam panel has a closed cavity, which is directly adjacent to the double layer.

9. The transducer arrangement as claimed in claim 8, wherein the cavity is air-filled.

10. The transducer arrangement as claimed in claim 8, wherein the cavity is enclosed by a frame, which has a U-shaped cross section with a base plate and a circumferential frame limb, and the double layer which rests on the free ends of the frame limb and covers the base plate at a distance from it.

11. The transducer arrangement as claimed in claim 8, wherein electrical and electronic components which are connected to the transducer elements are accommodated in the cavity.

12. The transducer arrangement as claimed in claim 1, wherein the transducer elements are in the form of spherical ceramics.

13. The transducer arrangement as claimed in claim 12, wherein the transducer elements are in the form of ceramic hollow spheres.

14. The transducer arrangement as claimed in claim 3, wherein the spacers are composed of polyurethane.

15. An electroacoustic transducer arrangement for underwater antennas, having transducer elements which are at a distance from one another, having a reflector which is arranged behind the transducer elements in the sound incidence direction and has a metal plate which faces the transducer elements, and a closed cavity which is located on the side of the metal plate facing away from the transducer elements, and having hard encapsulation composed of an elastomer which surrounds the transducer elements and the reflector, wherein the metal plate has a honeycomb structure, and a double layer, which is composed of a foam layer which rests on the metal plate and of a material layer which faces the closed cavity and is composed of a material whose acoustic impedance is very much less than that of water, is arranged between the metal plate and the closed cavity.

16. The transducer arrangement as claimed in claim 15, wherein the double layer has a layer thickness which is small in comparison to the thickness of the closed cavity and is preferably approximately 6 mm.

17. The transducer arrangement as claimed in claim 15, wherein the transducer elements are fixed to spacers, which are attached to the metal plate and are composed of plastic and the height of the spacers is chosen such that the distance between the acoustic center of the transducer elements and the reflector for a broadband transducer arrangement is small in comparison to the mean wavelength $\lambda$, and is less than one quarter of the wavelength $\lambda$ for a narrowband transducer arrangement.

18. The transducer arrangement as claimed in claim 15, wherein a surface of the metal plate which points toward the transducer elements is coated with a thin material layer composed of a material whose acoustic impedance is very much less than that of water.

19. The transducer arrangement as claimed in claim 18, wherein the cavity is air filled and is enclosed by a frame, which has a U-shaped cross section with a base plate and a circumferential frame limb, and the double layer which rests on the free ends of the frame limb and covers the base plate at a distance from it.

20. The transducer arrangement as claimed in claim 19, wherein electrical and electronic components which are connected to the transducer elements are accommodated in the cavity.

* * * * *